US011120754B2

(12) United States Patent
Chen

(10) Patent No.: US 11,120,754 B2
(45) Date of Patent: Sep. 14, 2021

(54) DISPLAY PANEL DRIVING METHOD, DRIVING DEVICE AND DISPLAY DEVICE

(71) Applicants: HKC Corporation Limited, Guangdong (CN); Chongqing HKC Optoelectronics Technology Co., Ltd., Chongqing (CN)

(72) Inventor: Yu-Jen Chen, Chongqing (CN)

(73) Assignees: HKC Corporation Limited, Guangdong (CN); Chongqing HKC Optoelectronics Technology, Co., Ltd., Chongqing (CN)

( * ) Notice: Subject to any disclaimer, the term of this patent is extended or adjusted under 35 U.S.C. 154(b) by 0 days.

(21) Appl. No.: 16/610,813

(22) PCT Filed: May 4, 2018

(86) PCT No.: PCT/CN2018/085673

§ 371 (c)(1),
(2) Date: Nov. 4, 2019

(87) PCT Pub. No.: WO2018/202150

PCT Pub. Date: Nov. 8, 2018

(65) Prior Publication Data

US 2020/0074945 A1 Mar. 5, 2020

(30) Foreign Application Priority Data

May 5, 2017 (CN) ..... 201710313112.6

(51) Int. Cl.
*G09G 3/36* (2006.01)

(52) U.S. Cl.
CPC ..... *G09G 3/3607* (2013.01); *G09G 3/3648* (2013.01); *G09G 2300/0443* (2013.01);
(Continued)

(58) Field of Classification Search
CPC ..... G09G 3/2003; G09G 2300/0452; G09G 2310/0254; G09G 3/3614
See application file for complete search history.

(56) References Cited

U.S. PATENT DOCUMENTS 8,970,564 B2 3/2015 Moon et al.
2005/0099379 A1* 5/2005 Iisaka ..... G09G 3/3614 345/100

(Continued)

FOREIGN PATENT DOCUMENTS

CN 101763837 A 6/2010
CN 102820014 A 12/2012

(Continued)

OTHER PUBLICATIONS

International Search Report for Application No. PCT/CN2018/085673 dated Jul. 18, 2018, 2 pages.

(Continued)

*Primary Examiner* — Kevin M Nguyen
(74) *Attorney, Agent, or Firm* — Seyfarth Shaw LLP

(57) ABSTRACT

The present application is a display panel driving method, a driving device and a display device. The method comprises: forming 2n rows of sub-pixels in a display panel into a sub-pixel group, and dividing the sub-pixel group into a first sub-pixel group and a second sub-pixel group using a grouping method. The display panel comprises pixel units arranged in an array; each pixel unit comprises sub-pixels of at least three colors, and the sub-pixels of each color comprises sub-pixels of a first type and sub-pixels of a second type; and the sub-pixels of the first type and the sub-pixels of the second type are arranged at intervals along the row direction and the column direction of the pixel unit arrangement, and the data signal levels of the two provided by a driving module thereof are different.

14 Claims, 7 Drawing Sheets

(52) U.S. Cl.
CPC ..... *G09G 2300/0447* (2013.01); *G09G 2300/0452* (2013.01); *G09G 2320/068* (2013.01); *G09G 2320/0673* (2013.01); *G09G 2330/021* (2013.01); *G09G 2330/023* (2013.01); *G09G 2330/04* (2013.01)

(56) References Cited

U.S. PATENT DOCUMENTS

| | | | | |
|---|---|---|---|---|
| 2005/0264548 | A1* | 12/2005 | Okamura | G09G 3/3688 345/204 |
| 2008/0129676 | A1 | 6/2008 | Kim et al. | |
| 2010/0156947 | A1 | 6/2010 | Moon et al. | |
| 2011/0164076 | A1 | 7/2011 | Lee | |
| 2011/0279443 | A1* | 11/2011 | Chang | G09G 3/3614 345/214 |
| 2012/0307174 | A1* | 12/2012 | Lee | G09G 3/3677 349/54 |
| 2014/0111410 | A1 | 4/2014 | Guo | |
| 2015/0279295 | A1* | 10/2015 | Shikata | G09G 3/3607 345/694 |
| 2015/0379947 | A1* | 12/2015 | Sang | G02F 1/134309 349/37 |
| 2016/0322432 | A1* | 11/2016 | Yang | G09G 3/3208 |
| 2017/0219894 | A1 | 8/2017 | Cao | |
| 2017/0278444 | A1* | 9/2017 | Tien | G09G 3/2003 |
| 2018/0053461 | A1 | 2/2018 | Tien et al. | |
| 2018/0210304 | A1 | 7/2018 | Wang | |
| 2019/0005902 | A1 | 1/2019 | Chen | |

FOREIGN PATENT DOCUMENTS

| | | | |
|---|---|---|---|
| CN | 103185976 | A | 7/2013 |
| CN | 104505041 | A | 4/2015 |
| CN | 105093746 | A | 11/2015 |
| CN | 106019746 | A | 10/2016 |
| CN | 106328039 | A | 1/2017 |
| CN | 106920527 | A | 7/2017 |
| JP | 2000250496 | A | 9/2000 |
| JP | 2004004857 | A | 1/2004 |

OTHER PUBLICATIONS

Chinese Office Action for Application No. 201710313112.6 dated Nov. 1, 2017, 3 pages.

Non-final Office Action for U.S. Appl. No. 16/611,240 dated Sep. 14, 2020, 20 pages.

U.S. Office Action for U.S. Appl. No. 16/611,210 dated Mar. 1, 2021, 20 pages.

* cited by examiner

DISPLAY PANEL DRIVING METHOD, DRIVING DEVICE AND DISPLAY DEVICE

CROSS REFERENCE TO RELATED APPLICATIONS

This is a U.S. National Stage application of, and claims priority to, PCT/CN2018/085673, filed May 4, 2018, which further claims priority to Chinese Patent Application No. 201710313112.6, filed Nov. 8, 2018, the disclosures of which are incorporated herein by reference in their entirety.

TECHNICAL FIELD

The embodiments of the application relate to the technical field of display, and particularly to a driving method and an driving apparatus of a display panel, and a display device.

BACKGROUND

With the development of liquid crystal display (LCD) panel, large viewing angle and low cost have become the important indexes of LCD panel. Among the technologies for reducing the cost of the LCD panel, the three-gate technology has been widely used because of its fast data transmission speed. By using the three-gate technology, the charging time of the pixel electrode can be shortened to ⅓ of the original charging time. Correspondingly, the operating frequency of the driving module which provides the data signals becomes three times of the original.

In order to realize that wide viewing angle of the LCD panel, the pixel units in the LCD panel are generally processed by gamma correction. After the gamma correction processing, the level of the data signal of a sub-pixel in the LCD panel is different from that of its neighboring sub-pixels in the column direction and the row direction. As a result, in the row direction and the column direction in which the pixel units are arranged, the deflection direction of the liquid crystal molecule corresponding to each sub-pixel is different from that corresponding to the neighboring sub-pixels. The liquid crystal molecules arranged in different directions in the LCD panel generate a diffuse reflection-like effect, thereby increasing the viewing angle when viewing the LCD panel, whereby a wide viewing angle of the LCD panel is effected.

Combining the low-cost three-gate technology and the wide-view gamma correction technology, the three-gate technology itself has already increased the working frequency of the driving module, together that the levels of the data signals to the sub-pixels and the adjacent sub-pixels after gamma correction are not the same. As such, the level jump frequencies of the data signals provided by the driving module are greatly increased, the power consumption of the driving module providing the data signals is increased and, in a worst case scenario, may even damage the driving module.

SUMMARY

Accordingly, it is necessary to provide a driving method and a driving apparatus of a display panel and a display device, while the cost of the LCD panel is reduced by implementing the three-gate technology, the operating frequency of the driving module providing the data signals is also reduced, thereby reducing the power consumption of the driving module as well as the risk of damaging the driving module.

A driving method of a display panel, includes:

grouping each 2n rows of sub-pixels in the display panel into a sub-pixel group, dividing the sub-pixel group into a first sub-pixel group and a second sub-pixel group with a dividing manner, with n being a positive integer greater than 1; for the sub-pixel group composed of 2n rows of sub-pixels, firstly driving the sub-pixels in the first sub-pixel group to display, and then driving the sub-pixels in the second sub-pixel group to display; or for the sub-pixel group composed of 2n rows of sub-pixels, firstly driving the sub-pixels in the second sub-pixel group to display, and then driving the sub-pixels in the first sub-pixel group to display; the display panel includes a plurality of pixel units arranged in an array; each of the pixel units comprises at least three colors of sub-pixels, each color of sub-pixels includes a first type of sub-pixels and a second type of sub-pixels; and the first type of sub-pixels and the second type of sub-pixels are arranged alternately in a row direction and a column direction in which the pixel units are arranged, and the levels of data signals provided by the driving module to the first type of sub-pixels and the second type of sub-pixels are different.

Optionally, the dividing manner includes grouping odd rows of the sub-pixels in the sub-pixel group arranged in a second direction into the first sub-pixel group and grouping even rows of the sub-pixels in the sub-pixel group arranged in the second direction into the second sub-pixel group.

Optionally, the dividing manner includes grouping odd columns of the sub-pixels in the sub-pixel group into the first sub-pixel group and grouping even columns of the sub-pixels in the sub-pixel group into the second sub-pixel group.

Optionally, the dividing manner includes grouping odd rows of the sub-pixels in the sub-pixel group arranged in a third direction into the first sub-pixel group and grouping even rows of the sub-pixels in the sub-pixel group arranged in the third direction into the second sub-pixel group.

Optionally, when a row of sub-pixels is driven for display, a scan signal is provided through a scan line corresponding to the row of sub-pixels, and the data signals are provided through a data line corresponding to the row of sub-pixels; a level variation period of the data signals on each data line is 2n times the duration of the scan signal; and each row of sub-pixels corresponds to the same scan line, and each column of sub-pixels corresponds to the same data line.

Optionally, each of the pixel units in the display panel includes a red sub-pixel, a green sub-pixel, and a blue sub-pixel in a column direction in which the pixel units are arranged; the first type of sub-pixels and the second type of sub-pixels of each color of sub-pixels are arranged adjacently in the row direction in which the pixel units are arranged.

Optionally, each of the sub-pixel groups includes six rows of sub-pixels or twelve rows of sub-pixels and the colors of the sub-pixels of the same row are the same.

Optionally, blue sub-pixels in the first sub-pixel group are firstly driven for display when the sub-pixels in the first sub-pixel group are driven for display.

Optionally, the blue sub-pixels in the second sub-pixel group are firstly driven for display when the sub-pixels in the second sub-pixel group are driven for display.

Embodiments of the present application further provide a driving apparatus of a display panel, including: a grouping module configured to group each 2n rows of sub-pixels in the display panel into a sub-pixel group, and divide the pixel group into a first sub-pixel group and a second sub-pixel group with a dividing manner, with n being a positive integer greater than 1; a driving module configured to, for the sub-pixel group composed of 2n rows of sub-pixels, firstly drive the sub-pixels in the first sub-pixel group to display, and then drive the sub-pixels in the second sub-pixel group to display; or for the sub-pixel group composed of 2n rows of sub-pixels, firstly drive the sub-pixels in the second sub-pixel group to display, and then drive the sub-pixels in the first sub-pixel group to display; and the display panel includes a plurality of pixel units arranged in an array; each of the pixel units includes at least three colors of sub-pixels, each color of sub-pixels comprises a first type of sub-pixels and a second type of sub-pixels; and the first type of sub-pixels and the second type of sub-pixels are arranged alternately in a row direction and a column direction in which the pixel units are arranged, and the levels of data signals provided by the driving module to the first type of sub-pixels and the second type of sub-pixels are different.

Optionally, the dividing manner includes grouping odd rows of the sub-pixels in the sub-pixel group arranged in a second direction into the first sub-pixel group and grouping even rows of the sub-pixels in the sub-pixel group arranged in the second direction into the second sub-pixel group.

Optionally, the dividing manner includes grouping odd columns of the sub-pixels in the sub-pixel group into the first sub-pixel group and grouping even columns of the sub-pixels in the sub-pixel group into the second sub-pixel group.

Optionally, the dividing manner includes group odd rows of the sub-pixels in the sub-pixel group arranged in a third direction into the first sub-pixel group and grouping even rows of the sub-pixels in the sub-pixel group arranged in the third direction into the second sub-pixel group.

Optionally, the driving module includes a plurality of scan lines and a plurality of data lines, each row of sub-pixels corresponds to the same scan line and each column of sub-pixels corresponding to the same data line; when a row of sub-pixels is driven for display, the driving module is configured to provide a scan signal through the scan line corresponding to the row of sub-pixels; and a level variation period of the data signals on each data line is 2n times the duration of the scan signal.

Optionally, each of the sub-pixel groups of the display panel includes six rows of sub-pixels and the colors of the sub-pixels of the same row are the same.

Optionally, each of the sub-pixel groups of the display panel includes twelve rows of sub-pixels and the colors of the sub-pixels of the same row are the same.

Optionally, the driving apparatus is further configured to: firstly drive blue sub-pixels in the first sub-pixel group to display when the sub-pixels in the first sub-pixel group are driven for display.

Optionally, the driving apparatus is further configured to: firstly drive the blue sub-pixels in the second sub-pixel group for display when the sub-pixels in the second sub-pixel group are driven for display.

A display device, includes a display panel; and the foregoing driving apparatus.

According to embodiments of the present disclosure, a driving method and a driving apparatus of a display panel and a display device are provided. 2n rows of sub-pixels in the display panel are grouped into a sub-pixel group, the sub-pixel group is divided into a first sub-pixel group and a second sub-pixel group with a dividing manner, with n being a positive integer greater than 1; for a sub-pixel group composed of 2n lines of sub-pixels, the sub-pixels in the first sub-pixel group are firstly driven for display; then the sub-pixels in the second sub-pixel group for display; or the sub-pixels in the second sub-pixel group are driven for display; then the sub-pixels in the first sub-pixel group are driven for display; and the display panel is configured to include a plurality of pixel units arranged in an array; each of the pixel units includes at least three colors of sub-pixels, each color of sub-pixels includes a first type of sub-pixels and a second type of sub-pixels; the first type of sub-pixels and the second type of sub-pixels are arranged alternately in the row direction and in the column direction in which the pixel units are arranged, and the levels of the data signals provided by the driving module to the first type of sub-pixels and the second type of sub-pixels are set to be different. In other words, by firstly driving odd rows of sub-pixels for display and then driving even rows of sub-pixels of for display, or driving even rows of sub-pixels of for display and then driving odd rows of sub-pixels for display, it is possible to drive simultaneously at least two rows of sub-pixels of which data signals have the same level, and reduce the jump frequencies of the levels of the data signals provided by the driving module. While the cost of the LCD panel is lowered by implementing the three-gate technology, the operating frequency of the driving module providing the data signals is also reduced, thereby reducing the power consumption of the driving module as well as the risk of damaging the driving module.

BRIEF DESCRIPTION OF THE DRAWINGS

To illustrate the technical solutions according to the embodiments of the present disclosure or in the prior art more clearly, the accompanying drawings for describing the embodiments or the prior art are introduced briefly in the following. Apparently, the accompanying drawings in the following description are only some embodiments of the present disclosure, and persons of ordinary skill in the art can derive other drawings from the accompanying drawings without creative efforts.

DETAILED DESCRIPTION OF THE EMBODIMENTS

Figure 1:
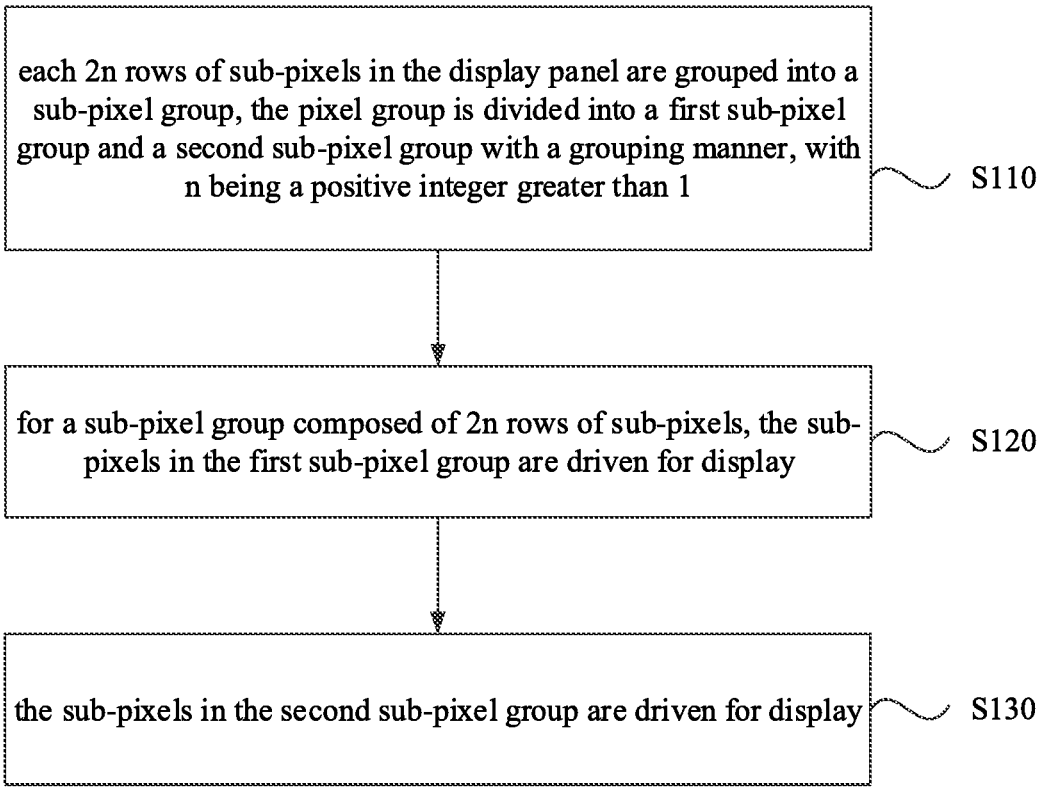
FIG. 1 is a flowchart of a driving method of a display panel according to an embodiment of the present disclosure.

The present disclosure will be described in details in combination with the accompanying drawings and embodiments such that the purpose, technical solution, and advantages of the present disclosure will be more apparent. It may be evident however, the embodiments described are merely a part, as opposed to all, of the embodiments of the disclosure. All other embodiments obtained by persons of ordinary skill in the art without creative efforts and based on the embodiments of the present disclosure are within the scope of the present disclosure. It should also be noted that, for purposes of explanation, only some, rather than all, of the structures relevant to the present disclosure are shown in the drawings. Like or similar reference numerals are used to refer to like or similar structures, elements, or processes throughout. It should be noted that the respective technical features involved in the respective embodiments can be combined arbitrarily between the respective embodiments to the extent they have no collision with each other.

FIG. 1 is a flowchart of a driving method of a display panel according to an embodiment of the present disclosure. The technical solution of the illustrated embodiment can be performed by the driving apparatus of a display panel provided in the embodiment of the present disclosure. The method includes:

At S110: each 2n rows of sub-pixels in the display panel are grouped into a sub-pixel group, the sub-pixel group is divided into a first sub-pixel group and a second sub-pixel group with a dividing manner, with n being a positive integer greater than 1. In one embodiment, the present disclosure further includes to group the odd rows of sub-pixels in the sub-pixel into a first sub-pixel group and to group the even rows of sub-pixels in the sub-pixel group into a second sub-pixel group, with n being a positive integer greater than 1.

In another embodiment, the dividing manner may include grouping odd rows of the sub-pixels in the sub-pixel group arranged in a first direction into the first sub-pixel group and grouping even rows of the sub-pixels in the sub-pixel group arranged in the first direction into the second sub-pixel group; in another embodiment, the dividing manner may include grouping odd rows of the sub-pixels in the sub-pixel group arranged in a second direction into the first sub-pixel group and grouping even rows of the sub-pixels in the sub-pixel group arranged in the second direction into the second sub-pixel group; in another embodiment, the dividing manner may include group odd rows of the sub-pixels in the sub-pixel group arranged in a third direction into the first sub-pixel group and grouping even rows of the sub-pixels in the sub-pixel group arranged in the third direction into the second sub-pixel group, and the first direction, the second direction, and the third directions are different directions.

Furthermore, the second direction and the first direction are spaced with a first direction angle which may be one of 30 degrees, 45 degrees, 60 degrees, and 90 degrees; the third direction and the second direction are spaced with a second direction angle which may be one of 30 degrees, 45 degrees, 60 degrees, and 90 degrees. Specifically, the angles of the first direction angle and the second direction angle are multiples of the angle of the adjacent sub-pixels in the display panel.

Figure 2:
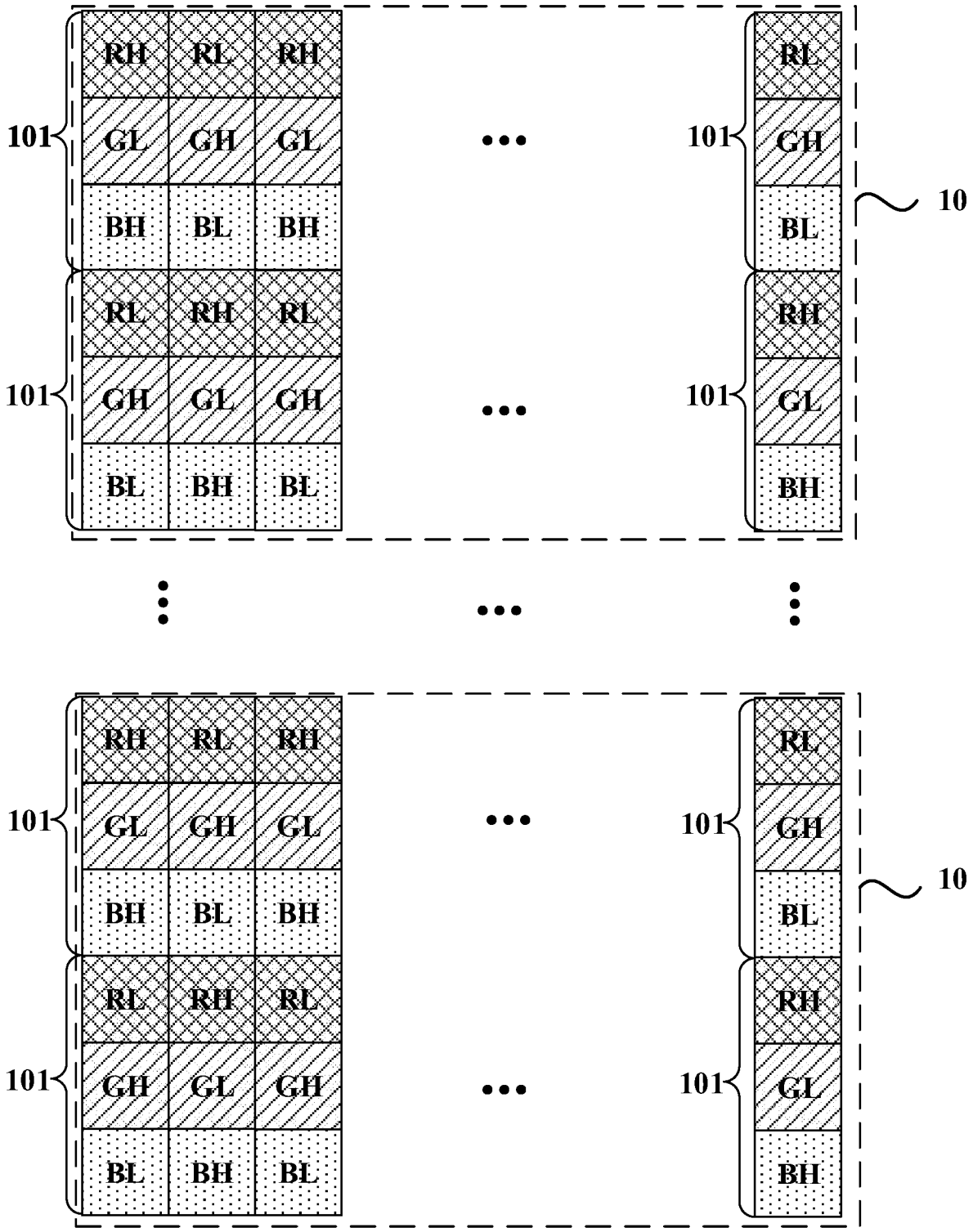
FIG. 2 is a schematic diagram of a sub-pixel arrangement sequence of a display panel according to an embodiment of the present disclosure.

FIG. 2 is a schematic diagram of a sub-pixel arrangement sequence of a display panel according to an embodiment of the present disclosure. As shown in FIG. 2, the display panel includes a pixel array composed of pixels 101 arranged in a plurality of rows and columns; each of the pixels 101 includes sub-pixels of at least three colors, the sub-pixels of each color include a first type of sub-pixels and a second type of sub-pixels, the first type of sub-pixels and the second type of sub-pixels are arranged alternately in a row direction and a column direction in which the pixel array is arranged. The levels of the data signals provided by the driving module to the first type of sub-pixels and the second type of sub-pixels are different.

Referring to FIG. 2, by way of example, each of the pixels 101 in the display panel includes a red sub-pixel R, a green sub-pixel G, and a blue sub-pixel B in a column direction in which the pixel array is arranged. A first type of sub-pixels and a second type of sub-pixels of the sub-pixels of each color are disposed adjacently in a row direction in which the pixel array is arranged. That is, the red sub-pixels R include a first type of sub-pixels RH and a second type of sub-pixels RL, the green sub-pixels G include a first type of sub-pixels GH and a second type of sub-pixels GL, and the blue sub-pixels B include a first type of sub-pixels BH and a second type of sub-pixels BL, and the first type of sub-pixels RH and the second type of sub-pixels RL, the first type of sub-pixels GH and the second type of sub-pixels GL, the first type of sub-pixels BH and the second type of sub-pixels BL are respectively disposed adjacently in the row direction in which the pixel array is arranged. By way of example, levels of the data signals provided by the driving module to the first type of sub-pixels RH, GH, and BH are set to be high, and the levels of the data signals provided by the driving module to the second type of sub-pixels RL, GL, and BL are set to be low. The scale of the level may be relative, i.e., the levels of the data signals provided by the driving module to the first type of sub-pixels are higher than the levels of the data signals provided by the driving module to the second type of sub-pixels. The first type of sub-pixels and the second type of sub-pixels are arranged alternately in the row direction and the column direction in which the pixel array is arranged.

By way of example, as shown in FIG. 2, RH, GL, BH, RL, GH and BL are arranged alternately in the column direction in which the pixel array is arranged, and RH and RL, GH and GL, BH and BL are respectively arranged adjacently in the row direction in which the pixel array is arranged.

It should be noted that in FIG. 2, each of the pixels 101 is only illustratively configured to include sub-pixels of three colors. So long as each of the pixels 101 is configured to include sub-pixels of at least three colors, the number of sub-pixels of each of the pixels 101 is not limited. The arrangement order of the colors of the sub-pixels in each of the pixels 101 is also not limited. As an example, for the arrangement order of the sub-pixels in each of the pixels 101, the arrangement order of the sub-pixels in each of the pixels in the display panel may be any one of RGB, RBG, GBR, GRB, BRG and BGR. Also, in FIG. 2, by way of example, the levels of the data signals provided by the driving module to the first type of sub-pixels RH, GH, and BH are set to be high, and the levels of the data signals provided by the driving module to the second type of sub-pixels RL, GL, and BL are set to be low; it is also possible that the levels of the data signals provided by the driving module to the first type of sub-pixels RH, GH, and BH are set to be low, and the levels of the data signals provided by the driving module to the second type of sub-pixels RL, GL, and BL are set to be high. These are not limited by the embodiments of the application.

For the purpose of explanation, in the following embodiments, the arrangement order of the sub-pixels in each of the pixels 101 is RGB, the levels of the data signals provided by the driving module to the first type of sub-pixels RH, GH and BH are high, and the levels of the data signals provided by the driving module to the second type of sub-pixels RL, GL and BL are low. A first sub-pixel in each sub-pixel group 10 is described, as an example, as the first type of sub-pixels RH, as shown in FIG. 2.

Each 2n rows of sub-pixels in the display panel are grouped into a sub-pixel group 10, the odd rows of sub-pixels in the sub-pixel group 10 are grouped into a first sub-pixel group, and even rows of sub-pixels in the sub-pixel group 10 are grouped into a second sub-pixel group, with n being a positive integer greater than 1. Optionally, n may be any positive integer greater than 1, and each sub-pixel group 10 may include six rows of sub-pixels or twelve rows of sub-pixels. The colors of the sub-pixels of the same row may be the same or different. In the embodiments, the specific value of n and the colors of sub-pixels of the same row are not limited. For the purpose of explanation, the following embodiments will be described, by way of example, that six rows of sub-pixels are included in each sub-pixel group 10 and the colors of the sub-pixels of the same row are the same, as shown in FIG. 2. For each pixel group 10, the first sub-pixel group includes sub-pixels of rows 1, 3, and 5, and the second sub-pixel group includes sub-pixels of rows 2, 4, and 6.

Figure 3:
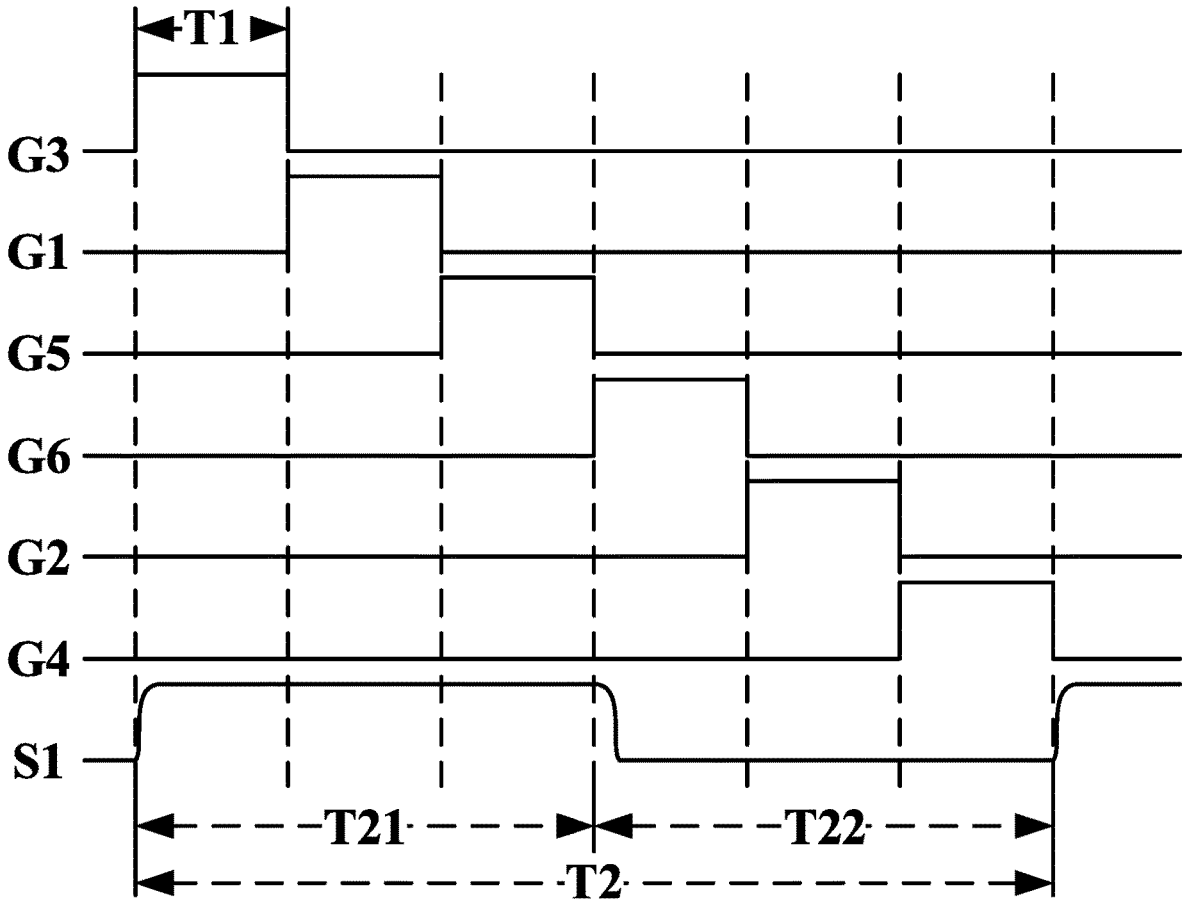
FIG. 3 is a timing chart of driving the display panel shown in FIG. 2.

Optionally, when a row of sub-pixels is driven for display, a scan signal is provided through a scan line corresponding to the row of sub-pixels, and data signals are provided from a data line corresponding to the row of sub-pixels. Each row of sub-pixels may correspond to the same scan line, and each column of sub-pixels may correspond to the same data line. FIG. 3 is a timing chart of driving the display panel shown in FIG. 2, in which G1-G6 are six scanning signals corresponding to six rows of sub-pixels in one sub-pixel group 10. In FIG. 3, by way of example, the variation pattern along with G1-G6 and of the data signals S1 corresponding to the first column of sub-pixels in the sub-pixel group 10 is illustrated. The variation frequencies of the data signals corresponding to the other columns of sub-pixels are the same as the data signals S1 corresponding to the first column of sub-pixels. Each of the scan signals may provide a trigger signal for each row of sub-pixels. Also in FIG. 3, a scan signal is configured to input in a certain order a high-level signal with a sustain time T1, or a low-level signal, by way of example, the scan signal as the trigger signal is high level herein. When the data signals corresponding to a certain row of sub-pixels in the sub-pixel group 10 are at a high level, the row of sub-pixels is displayed, and the data line corresponding to the row of sub-pixels provides the data signal to the sub-pixels in the row.

At S120: for a sub-pixel group composed of 2n rows of sub-pixels, the sub-pixels in the first sub-pixel group are driven for display.

During displaying, with respect to the arrangement order of the sub-pixels of the display panel shown in FIG. 2, for the sub-pixel group 10 composed of the 2n rows of sub-pixels, the sub-pixels in the first sub-pixel group is firstly driven for display, i.e., the odd rows of sub-pixels are firstly driven for display, n is a positive integer greater than 1, and n is set to be 3 by way of example. As shown in FIG. 3, the odd rows of sub-pixels are firstly driven for display, i.e., the 1st, 3rd and 5th rows of sub-pixels are firstly driven for display. The 1st, 3rd and 5th rows of sub-pixels of each column of sub-pixels are, for example, the first type of sub-pixels, i.e., the levels of data signals provided by the driving module to the odd rows of sub-pixels are high. Taking the first column of sub-pixels as an example, as shown in FIG. 3, in the first stage T21 of driving the odd rows of sub-pixels in the sub-pixel group 10, since the sub-pixels of rows 1, 3 and 5 of each column of sub-pixels are the first type of sub-pixels, the levels of the data signals provided by the data lines of the driving module to the first type of sub-pixels are high, and the levels of the data signals S1 on the data lines corresponding to the odd rows of sub-pixels of the first column are high and do not jump. While in the driving method of the display panel provided in the prior art, to drive the same three sub-pixels for display, the levels of the data signals on the data lines corresponding to each column of sub-pixels will jump twice. The driving method provided in this embodiment reduces the jump frequencies of the levels of the data signals and thereby reducing the power consumption of the driving module.

At S130: the sub-pixels in the second sub-pixel group are driven for display.

During displaying, the sub-pixels in the second sub-pixel group in the sub-pixel group 10 are driven for display, that is, even rows of sub-pixels are driven for display. As shown in FIG. 3, in the second stage T22, even rows of sub-pixels in the sub-pixel group 10 are driven for display, that is, sub-pixels in rows 2, 4 and 6 are driven for display. For example, sub-pixels in rows 2, 4 and 6 of each column of sub-pixels are the second type of sub-pixels, that is, the levels of the data signals provided by the driving module to the sub-pixels of the even rows are low. Taking the first column of sub-pixels in the sub-pixels as an example, as shown in FIG. 3, in the second stage T22 of driving the even rows of sub-pixels in the sub-pixel group 10, since the sub-pixels of rows 2, 4 and 6 of each column of sub-pixels are the second type of sub-pixels, and the levels of the data signals provided by the data lines of the driving module to the second type of sub-pixels are low, the levels of the data signals S1 on the data lines corresponding to the even rows of sub-pixels of the first column are low and do not jump. Similarly, in the driving method of the display panel provided in the prior art, to drive the same three rows of sub-pixels for display, the levels of the data signals on the data line corresponding to each column of sub-pixels will jump twice. The driving method provided herein reduces the jump frequencies of the levels of the data signals and thereby reducing the power consumption of the driving module.

Optionally, as shown in FIG. 3, the duration of each of the scan signals is T1. The sub-pixels in the display panel are driven in an order that, in the sub-pixel group 10 composed of 2n sub-pixels, the odd rows of sub-pixels are firstly driven for display and then the even rows of sub-pixels are driven for display. In this way, the variation period of the levels of the data signals on each data line is T2, and T2 is 2n times that of T1. For example, n is 3, and T2 is 6 times that of T1 as shown in FIG. 3. While the cost of the LCD panel is lowered by implementing the three-gate technology, the operating frequency of the driving module providing the data signals is also reduced, thereby reducing the power consumption of the driving module as well as the risk of damaging the driving module.

Optionally, for the timing of driving the display panel shown in FIG. 3, i.e., the first sub-pixel group in the sub-pixel group 10 (i.e., the odd rows of sub-pixels) is driven for display, and then the second sub-pixel group in the sub-pixel group 10 (i.e., the even rows of sub-pixels are driven for display) is driven for display, it is possible to firstly drive the blue sub-pixels B in the even rows of sub-pixels when driving the second sub-pixel group (i.e., the even rows of sub-pixels) for display. In FIG. 3, when the even rows, i.e., the 2nd, 4th and 6th rows of sub-pixels, are driven for display, as an example, the blue sub-pixels B of the even rows of sub-pixels are firstly driven for display; that is, the blue sub-pixels B of the 6th row in the sub-pixel group 10 are driven for display. In this way, the jump positions of the levels are located at the blue sub-pixels B when the levels of the data signals S1 are switched from high to low. Since the human eye is least sensitive to blue with respect to red and green, by causing the jump position of the levels of the data signals to be at the blue pixel B, the influence by the level jump of the data signals on the display effect of the display panel can be minimized.

Figure 4:
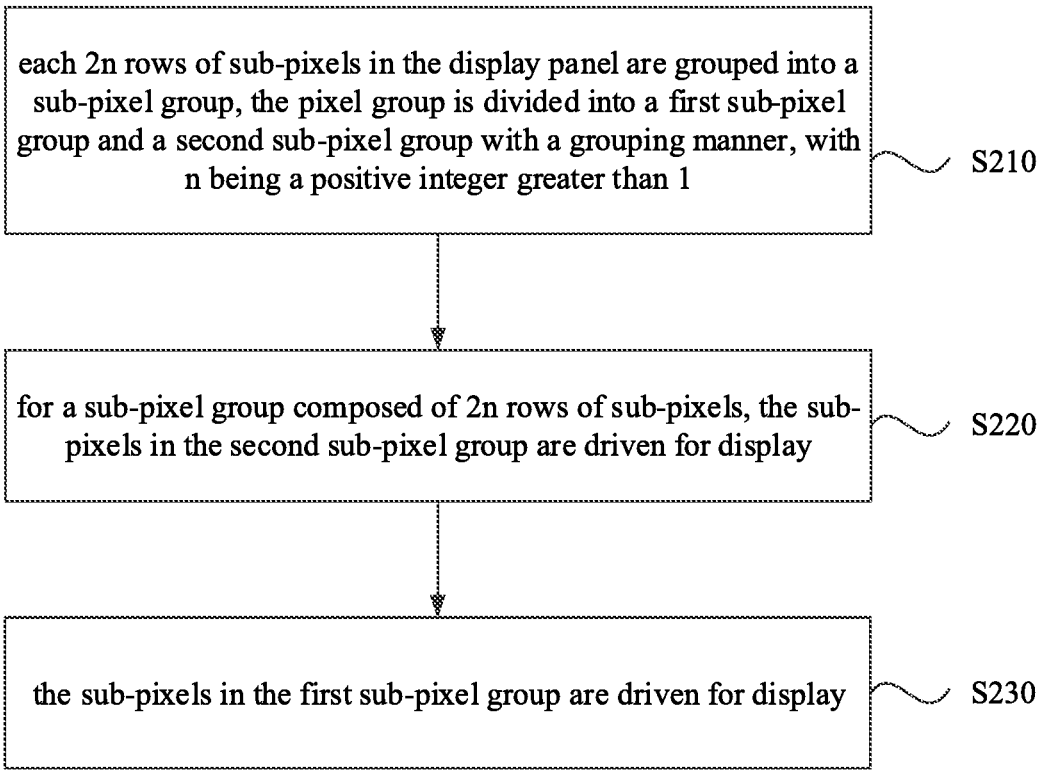
FIG. 4 is a flowchart of another driving method of a display panel according to an embodiment of the present disclosure.

It should be noted that in the display of the foregoing embodiment, for the sub-pixel group 10 composed of 2n rows of sub-pixels, the first sub-pixel group is firstly driven for display, that is, the odd rows of sub-pixels are driven for display, and then the second sub-pixel group is driven for display, that is, the even rows of sub-pixels are driven for display. It is also possible to firstly drive the second sub-pixel group, namely the even rows of sub-pixels for display, and then drive the first sub-pixel group, namely the odd rows of sub-pixels for display. FIG. 4 is a flow chart of another driving method of the display panel provided according to another embodiment of the present disclosure, the method includes:

At S210: each 2n rows of sub-pixels in the display panel are grouped into a sub-pixel group, and the sub-pixel group is divided into a first sub-pixel group and a second sub-pixel group with a dividing manner, with n being a positive integer greater than 1.

In one embodiment, the present disclosure further includes to group odd rows of the sub-pixels in the sub-pixel group into the first sub-pixel group and to group even rows of the sub-pixels in the sub-pixel group into the second sub-pixel group, with n being a positive integer greater than 1.

In another embodiment, the dividing manner is to group odd rows of the sub-pixels in the sub-pixel group arranged in a first direction into the first sub-pixel group and to group even rows of the sub-pixels in the sub-pixel group arranged in the first direction into the second sub-pixel group; in another embodiment, the dividing manner is to group odd rows of the sub-pixels in the sub-pixel group arranged in a second direction into the first sub-pixel group and to group even rows of the sub-pixels in the sub-pixel group arranged in the second direction into the second sub-pixel group; in another embodiment, the dividing manner is to group odd rows of the sub-pixels in the sub-pixel group arranged in a third direction into the first sub-pixel group and to group even crows of the sub-pixels in the sub-pixel group arranged in the third direction into the second sub-pixel group, and the first direction, the second direction, and the third directions are different directions.

Furthermore, the second direction and the first direction are spaced with a first direction angle which may be one of 30 degrees, 45 degrees, 60 degrees, and 90 degrees; the third direction and the second direction are spaced with a second direction angle which may be one of 30 degrees, 45 degrees, 60 degrees, and 90 degrees. Specifically, the angles of the first direction angle and the second direction angle are multiples of the angle of the adjacent sub-pixels in the display panel At S220: for a sub-pixel group composed of 2n rows of sub-pixels, the sub-pixels in the second sub-pixel group are driven for display.

At S230: the sub-pixels in the first sub-pixel group are driven for display.

Figure 5:
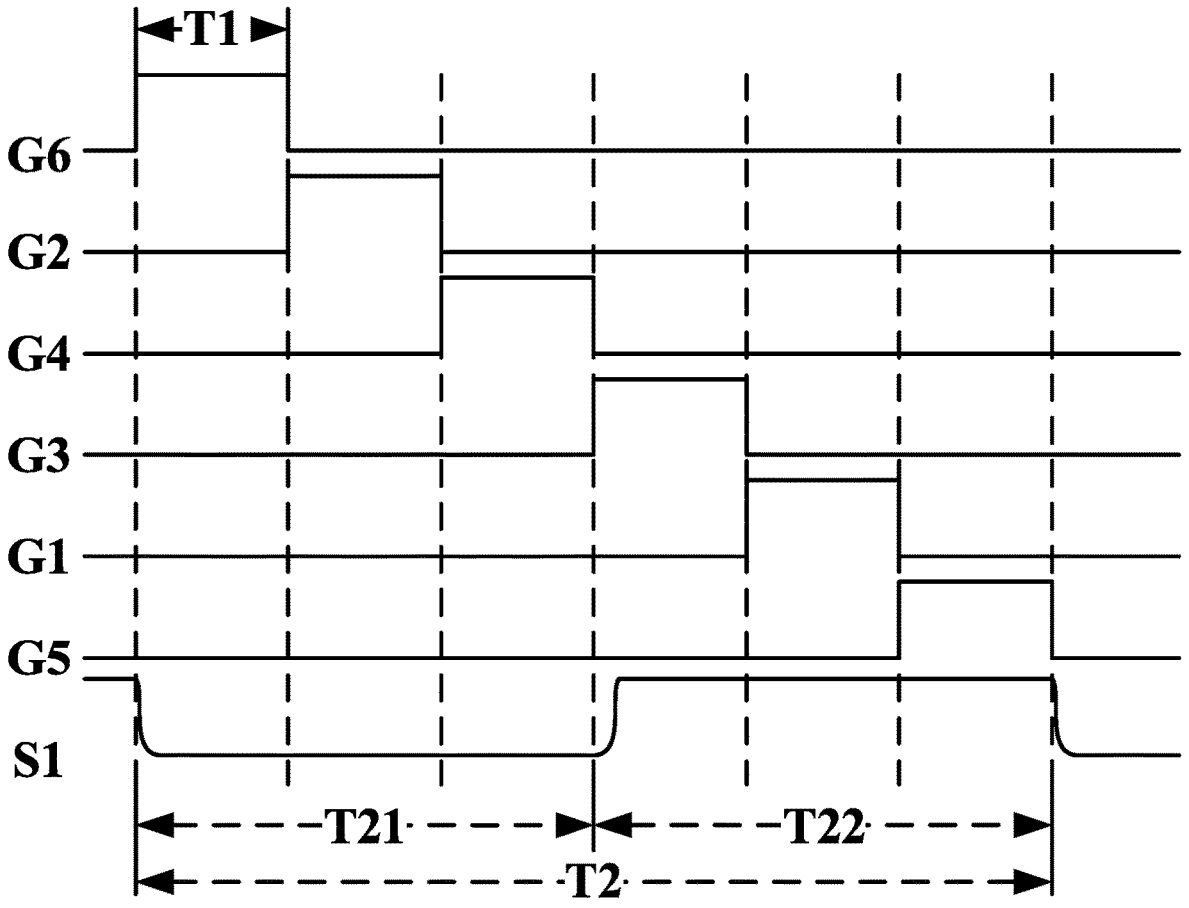
FIG. 5 is another timing chart of driving the display panel shown in FIG. 2.

Corresponding to the driving method of the display panel shown in FIG. 4, the timing chart of driving the display panel shown in FIG. 2 is shown in FIG. 5. The data signal S1 jumps from a low level in the first stage T21 to a high level in the second stage T22, and level variation period T2 of the data signals is 2n times the scanning signal duration T1. For example, n is 3, as shown in FIG. 5, T2 is 6 times of T1, which also reduces the jump frequencies of the levels of the data signals and thereby reducing the power consumption of the driving module.

Optionally, for the timing of driving the display panel shown in FIG. 5, i.e., the second sub-pixel group in the sub-pixel group 10 (i.e., the even rows of sub-pixels) is firstly driven for display, and then the first sub-pixel group in the sub-pixel group 10 (the odd rows of sub-pixels) is driven for display, it is possible to firstly drive the blue sub-pixels B in the odd rows of sub-pixels for display when the odd rows of sub-pixels are driven; that is, the blue sub-pixels B in the 3rd row of sub-pixels are firstly driven for display. Similarly, the jump positions of the levels of the data signals S1 can be caused to be at the blue sub-pixels B, thereby reducing the influence of the level jump of the data signals on the display effect of the display panel.

It should be noted that in the case the odd rows of sub-pixels in the sub-pixel group 10 are driven for display, FIGS. 3 and 5 are examples where the driving is performed in an order from the 3rd row to the 1st row and the 5th row. In the case the even rows of sub-pixels in the sub-pixel group 10 are driven for display, FIGS. 3 and 5 are examples where the driving is performed in an order from the 6th row to the 2nd row and the 4th row. The odd rows and the even rows of sub-pixels in the sub-pixel group 10 may be driven in other driving orders and are not limited thereto.

Figure 6:
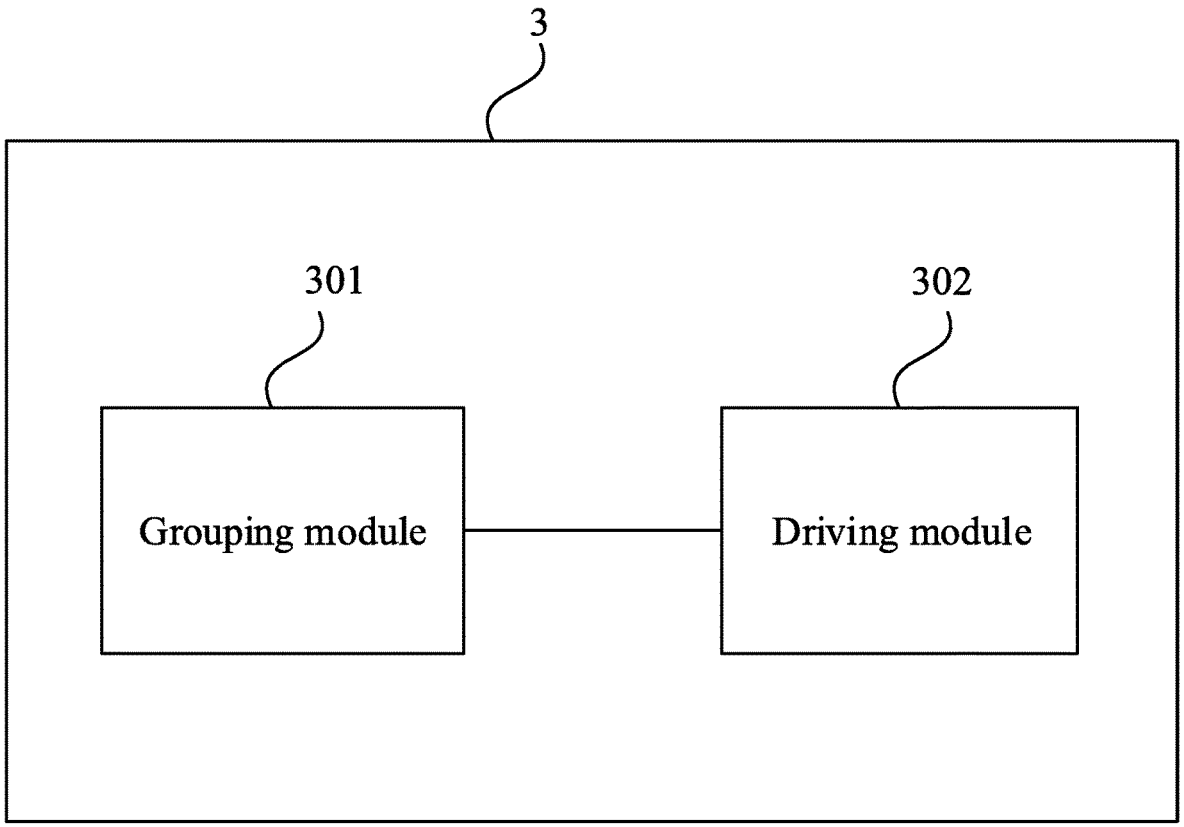
FIG. 6 is a schematic diagram of a structure of a driving apparatus of a display panel according to an embodiment of the present disclosure.

FIG. 6 is a schematic diagram of a structure of a driving apparatus of a display panel according to an embodiment of the present disclosure. The driving apparatus 3 includes a grouping module 301 and a driving module 302.

The grouping module 301 is configured to group each 2n rows of sub-pixels in the display panel into a sub-pixel group, group the odd rows of sub-pixels in the sub-pixel group into a first sub-pixel group, and group the even rows of sub-pixels in the sub-pixel group into a second sub-pixel group, with n being a positive integer greater than 1.

For the sub-pixel group composed of 2n rows of sub-pixels, the driving module 302 is configured to firstly drive the sub-pixels in the first sub-pixel group for display, then drive the sub-pixels in the second sub-pixel group for display, or firstly drive the sub-pixels in the second sub-pixel group for display and then drive the sub-pixels in the first sub-pixel group for display.

The display panel includes a plurality of pixel units arranged in an array, each pixel includes at least three colors of sub-pixels, each color of sub-pixels includes a first type of sub-pixels and a second type of sub-pixels, and the first type of sub-pixels and the second type of sub-pixels are disposed alternately in a row direction and a column direction in which the pixel array is arranged. The levels of the data signals provided by the driving module to the first type of sub-pixels and the second type of sub-pixels are different.

By way of example, the display panel in embodiments of the present disclosure may be, for example, an LCD display panel, an OLED display panel, a QLED display panel, a curved display panel, or other display panel.

Optionally, the driving module 302 includes a plurality of scan lines and a plurality of data lines, each row of sub-pixels corresponds to the same scan line, and each column of sub-pixels corresponds to the same data line. When a row of sub-pixels is driven for display, the driving module 302 may provide a scan signal through the scan line corresponding to the row of sub-pixels, and provide data signals through the data line corresponding to the row of sub-pixels. By way of example, the driving module 302 may include a data driving module, which may provide data signals to sub-pixels, and a gate driving module, which may provide scan signals to the sub-pixels.

Optionally, in the column direction in which the pixel array is arranged, each of the pixels in the display panel may include a red sub-pixel R, a green sub-pixel G, and a blue sub-pixel B, and the first type of sub-pixels and the second type of sub-pixels of each color disposed adjacently in the row direction in which the pixel array is arranged.

Optionally, each sub-pixel group of the display panel may include six rows of sub-pixels or twelve rows of sub-pixels, and the colors of the sub-pixels of the same row are the same.

Optionally, when the sub-pixels in the first sub-pixel group are driven for display, the blue sub-pixels in the first sub-pixel group are firstly driven for display. The blue sub-pixels in the second sub-pixel group are firstly driven for display when the sub-pixels in the second sub-pixel group are driven for display.

In the illustrated embodiment, 2n rows of sub-pixels in the display panel are grouped into a sub-pixel group, odd rows of sub-pixels in the sub-pixel group are grouped into a first sub-pixel group, and even rows of sub-pixels in the sub-pixel group are grouped into a second sub-pixel group, with n being a positive integer greater than 1; for a sub-pixel group composed of 2n rows of sub-pixels, the sub-pixels in the first sub-pixel group are firstly driven for display, then the sub-pixels in the second sub-pixel group are driven for display; or the sub-pixels in the second sub-pixel group are firstly driven for display, then the sub-pixels in the first sub-pixel group are driven for display; and the display panel is configured to include a plurality of pixel units arranged in an array; each of the pixel units includes at least three colors of sub-pixels, each color of sub-pixels includes a first type of sub-pixels and a second type of sub-pixels; the first type of sub-pixels and the second type of sub-pixels are arranged alternately in the row direction and the column direction in which the pixel units are arranged, and the levels of the data signals provided by the driving module to the first type of sub-pixels and the second type of sub-pixels are set to be different. In other words, by firstly driving odd rows of sub-pixels for display and then driving even rows of sub-pixels of for display, or driving even rows of sub-pixels of for display and then driving odd rows of sub-pixels for display, it is possible that at least two rows of sub-pixels of which data signals have the same level are simultaneously driven, and the jump frequencies of the levels of the data signals provided by the driving module is reduced. While the cost of the LCD panel is lowered by implementing the three-gate technology, the operating frequency of the driving module providing the data signals is also reduced, thereby reducing the power consumption of the driving module as well as the risk of damaging the driving module.

Figure 7:
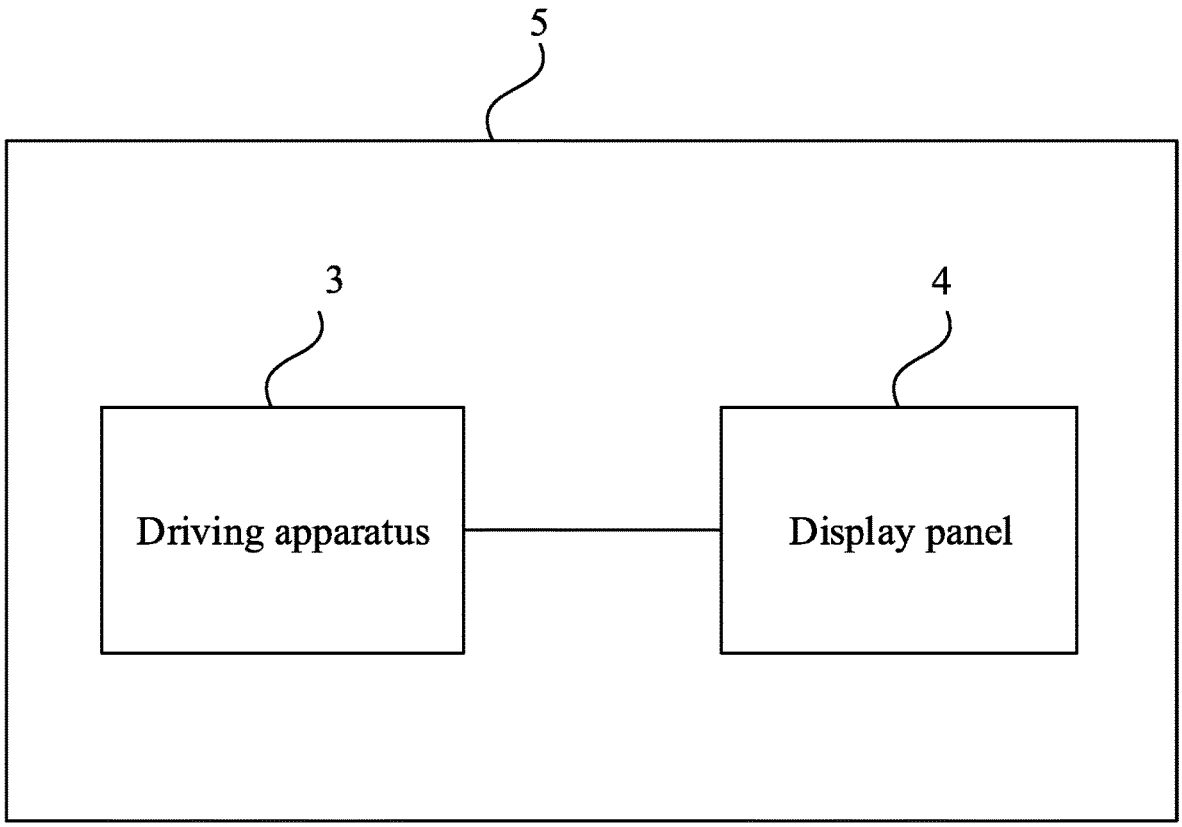
FIG. 7 is a schematic diagram of a structure of a display device according to an embodiment of the present disclosure.

According to the embodiment of the present disclosure, a display device is also provided. FIG. 7 is a schematic diagram of a structure of a display device according to an embodiment of the present disclosure. As shown in FIG. 7, the display device 5 includes the display panel 4 and the driving apparatus 3 described in the foregoing embodiments, so the display device provided in the embodiment of the present disclosure also has the advantageous effects described in the foregoing embodiment and is not described for brevity. By way of example, the display device provided in the embodiment of the present disclosure may be a mobile phone, a computer, etc., and is not limited thereto.

Please be noted that the foregoing is only the alternative embodiments and the applied technical principles of the present disclosure. It will be understood by those skilled in the art that the present disclosure is not limited to the particular embodiments herein, and that various obvious changes, adaptations, and substitutions can be made by those skilled in the art without departing from the scope of the present disclosure. Accordingly, although the present disclosure is described in more detail by the above embodiments, the present disclosure is not limited to the above embodiments, but may include more other equivalent embodiments without departing from the idea of the present disclosure, and the scope of the present disclosure is determined by the scope of the appended claims.

What is claimed is:

1. A method of driving a display panel, wherein the display panel includes pixel units arranged in an array, and wherein each of the pixel units includes a red sub-pixel, a green sub-pixel, and a blue sub-pixel in a column direction in which the pixel units are arranged, each of the red, green, and blue sub-pixels includes first and second types of sub-pixels, and the first and the second types of sub-pixels are arranged alternately in a row direction and a column direction in which the pixel units are arranged, the method comprising:

grouping rows of the sub-pixels in the display panel into a sub-pixel group, and dividing the sub-pixel group into first and second sub-pixel groups with a dividing manner;

providing a scan signal through a scan line corresponding to one of the rows of sub-pixels when the one row is driven for display;

providing data signals through data lines corresponding to the one row of sub-pixels driven for display, wherein levels of data signals provided by the driving module to the first type of sub-pixels and the second type of sub-pixels are different;

driving the blue sub-pixels in the first sub-pixel group for display when sub-pixels in the first sub-pixel group are driven for display in a first stage of the scan signal; and driving the blue sub-pixels in the second sub-pixel group for display when sub-pixels in the second sub-pixel group are driven for display in a second stage of the scan signal, wherein a jump of the data signals occurs only at a moment when the first stage of the scan signal transitions to the second stage of the scan signal, and a position of the jump of the data signals is located at the blue sub-pixels.

2. The driving method according to claim 1, wherein the dividing manner includes grouping odd numbered columns of the sub-pixels in the sub-pixel group into the first sub-pixel group and grouping even numbered columns of the sub-pixels in the sub-pixel group into the second sub-pixel group.

3. The driving method according to claim 2, wherein the first and second types of sub-pixels of each of the red, green, and blue sub-pixels are arranged adjacently in the row direction in which the pixel units are arranged.

4. The driving method according to claim 2, wherein the sub-pixels of the same row are the same color.

5. The driving method according to claim 1, wherein the dividing manner includes grouping odd numbered rows of the sub-pixels in the sub-pixel group arranged in a first direction into the first sub-pixel group and grouping even numbered rows of the sub-pixels in the sub-pixel group arranged in the first direction into the second sub-pixel group.

6. The driving method according to claim 5, wherein the dividing manner includes grouping odd numbered rows of the sub-pixels in the sub-pixel group arranged in a second direction into the first sub-pixel group and grouping even numbered rows of the sub-pixels in the sub-pixel group arranged in the second direction into the second sub-pixel group.

7. The driving method according to claim 6, wherein the dividing manner includes grouping odd numbered rows of the sub-pixels in the sub-pixel group arranged in a third direction into the first sub-pixel group and grouping even rows of the sub-pixels in the sub-pixel group arranged in the third direction into the second sub-pixel group.

8. A driving apparatus of a display panel, wherein the display panel includes pixel units arranged in an array, each of the pixel units having a red sub-pixel, a green sub-pixel, and a blue sub-pixel in a column direction in which the pixel units are arranged, each of the red, green, and blue sub-pixels including first and second types of sub-pixels, and the first and second types of sub-pixels are arranged alternately in a row direction and a column direction in which the pixel units are arranged, the driving apparatus comprising:

a grouping module configured to group six rows of sub-pixels in the display panel into a sub-pixel group, and to divide the sub-pixel group into first and second sub-pixel groups with a dividing manner;

a driving module configured to:

provide different levels of data signals to the first type of sub-pixels and the second type of sub-pixels;

provide a scan signal through a scan line corresponding to a row of sub-pixels when the row of sub-pixels is driven for display, provide data signals through data lines corresponding to the row of sub-pixels;

drive the blue sub-pixels in the first sub-pixel group for display when the sub-pixels in the first sub-pixel group are driven for display in a first stage by the scan signal; and drive the blue sub-pixels in the second sub-pixel group for display when the sub-pixels in the second sub-pixel group are driven for display in a second stage by the scan signal, wherein a jump of the data signals occurs only at a moment when the first stage of the scan signal transitions to the second stage of the scan signal, and a position of the jump of the data signals is located at the blue sub-pixels.

9. The driving apparatus according to claim 8, wherein the dividing manner includes grouping odd numbered columns of the sub-pixels in the sub-pixel group into the first sub-pixel group and grouping even numbered columns of the sub-pixels in the sub-pixel group into the second sub-pixel group.

10. The driving apparatus according to claim 8, wherein the dividing manner includes grouping odd numbered rows of the sub-pixels in the sub-pixel group arranged in a first direction into the first sub-pixel group and grouping even numbered rows of the sub-pixels in the sub-pixel group arranged in the first direction into the second sub-pixel group.

11. The driving apparatus according to claim 10, wherein the dividing manner includes group odd numbered rows of the sub-pixels in the sub-pixel group arranged in a second direction into the first sub-pixel group and grouping even numbered rows of the sub-pixels in the sub-pixel group arranged in the second direction into the second sub-pixel group.

12. The driving apparatus according to claim 11, wherein the dividing manner includes grouping odd numbered rows of the sub-pixels in the sub-pixel group arranged in a third direction into the first sub-pixel group and grouping even numbered rows of the sub-pixels in the sub-pixel group arranged in the third direction into the second sub-pixel group.

13. The driving apparatus according to claim 8, wherein the sub-pixels of the same row are the same color.

14. A display device, comprising a display panel; and a driving apparatus according to claim 8.

* * * * *